US008723493B2

(12) United States Patent
Ring

(10) Patent No.: US 8,723,493 B2
(45) Date of Patent: May 13, 2014

(54) METHODS AND APPARATUSES FOR INDUCTIVE ENERGY CAPTURE FOR FUZES

(75) Inventor: James A. Ring, Ramsey, MN (US)

(73) Assignee: Alliant Techsystems Inc., Arlington, VA (US)

( * ) Notice: Subject to any disclaimer, the term of this patent is extended or adjusted under 35 U.S.C. 154(b) by 567 days.

(21) Appl. No.: 12/899,326

(22) Filed: Oct. 6, 2010

(65) Prior Publication Data

US 2012/0204748 A1 Aug. 16, 2012

(51) Int. Cl.
*G05F 1/00* (2006.01)

(52) U.S. Cl.
USPC ..... 323/282

(58) Field of Classification Search
USPC ..... 102/215, 216, 220; 323/282, 285, 288
See application file for complete search history.

(56) References Cited

U.S. PATENT DOCUMENTS

| | | | | |
|---|---|---|---|---|
| 5,391,966 | A * | 2/1995 | Garrison | 315/308 |
| 5,894,102 | A | 4/1999 | Oberlin et al. | |
| 5,942,714 | A * | 8/1999 | Oberlin et al. | 89/6.5 |
| 6,176,168 | B1 * | 1/2001 | Keil et al. | 89/6.5 |
| 6,557,450 | B1 | 5/2003 | Cox et al. | |
| 6,621,256 | B2 | 9/2003 | Muratov et al. | |
| 7,015,716 | B2 | 3/2006 | Chen et al. | |
| 7,077,045 | B2 | 7/2006 | Dietrich et al. | |
| 7,170,260 | B2 | 1/2007 | Thrap | |
| 7,248,027 | B2 * | 7/2007 | Ribeiro et al. | 323/282 |
| 7,654,458 | B1 | 2/2010 | Kokodis et al. | |
| 7,667,482 | B2 | 2/2010 | Mort et al. | |
| 7,679,423 | B1 | 3/2010 | Nichols | |
| 8,022,680 | B2 * | 9/2011 | Ryoo | 323/282 |
| 8,283,901 | B2 * | 10/2012 | Lopata et al. | 323/224 |
| 2009/0195230 | A1 * | 8/2009 | Adkins et al. | 323/282 |
| 2011/0304378 | A1 * | 12/2011 | Sawyers | 327/360 |

* cited by examiner

*Primary Examiner* — Rexford Barnie
*Assistant Examiner* — Rasem Mourad
(74) *Attorney, Agent, or Firm* — TraskBritt

(57) ABSTRACT

Methods and apparatuses are disclosed for power conversion in fuzes for projectiles. Fuze electronics in the projectile control detonation of the projectile. A rectifier converts pulses from a setter signal to a DC power source signal. A voltage monitor coupled to the power source signal generates a source voltage indicator and a current monitor coupled to the power source signal generates a source current indicator. A combiner generates a supplied power level indicator in response to a combination of the source voltage indicator and the source current indicator. A DC-DC converter uses the supplied power level indicator when converting the power source signal to a power output signal to adjust a current level of the power output for efficient charging of a charge storage device and delivery of power to the fuze electronics.

29 Claims, 5 Drawing Sheets

METHODS AND APPARATUSES FOR INDUCTIVE ENERGY CAPTURE FOR FUZES

STATEMENT REGARDING FEDERALLY SPONSORED RESEARCH OR DEVELOPMENT

The U.S. Government has a paid-up license in this invention and the right in limited circumstances to require the patent owner to license others on reasonable terms as provided for by the terms of Contract No. W15QKN-06-C-0130 awarded by the Department of Defense.

TECHNICAL FIELD

Embodiments of the present invention relate generally to providing energy to fuzes for explosive projectiles and, more particularly, to controlling delivery of inductive power to charge storage devices and fuze electronics.

BACKGROUND

The following background description is provided to assist the understanding of the reader. None of the information provided or references cited in this background section is admitted to be prior art to the present invention.

Fuzes for explosive projectiles often receive programming information from a message coil in a projectile launcher that uses alternating current (AC) signals through inductive transfer to a receiver coil in the fuze to receive the message. This inductive message transfer device is often referred to as an inductive setter. In some fuzes, power may be extracted from the AC message to power the fuze, charge capacitors, or combinations thereof.

FIG. 1 illustrates a fuze circuitry used to extract power from an inductive setter 10. The AC signal on from the inductive setter 10 feeds a rectifier 20 including a full-wave diode bridge rectifier for converting the AC signal to a DC signal 25. A capacitor 30 may be used to filter the rectified voltage to create a more stable DC signal. The DC signal may drive fuze power circuitry 40 that may further condition and regulate the DC signal to provide power at varying loads to the fuze electronics. Excess power not used by the fuze power circuitry 40 may be captured by a capacitor in a capacitor charging circuit 50. The capacitor charging circuit 50 may provide power to the fuze electronics after the messaging has completed and the inductive setter 10 is no longer providing an AC signal. Generally, in such a configuration, the power output from the inductive setter 10 must be maintained at or below a specified average power level.

However, the energy storage capacitor starts to charge from zero volts, which appears as a virtual short circuit to a DC power source. As a result, current to the capacitor 30 must be limited to avoid exceeding the average power limit of the inductive setter 10. Previous designs limited the current to the capacitor 30 to a preset constant value until the storage capacitor was fully charged.

FIG. 2 illustrates a constant current power ramp 80 to a storage capacitor. Line 60 indicates a power limit for the inductive setter 10 (FIG. 2). As the capacitor voltage increases over time and with constant current, the power going into the capacitor increases linearly as illustrated by line 80 and reaches its maximum power level only when the capacitor is fully charged at time 70. Actual energy captured by the storage capacitor is illustrated by shaded area 90. Thus, the inductive setter 10 outputs its power limit 60 only at the very end of the capacitor charging period, limiting the energy capture efficiency to only 50%.

In addition, as the fuze load changes during the setting operation, (e.g., components are powered down after their data transfer is complete) there is no redirection of available energy to the storage capacitor. This means that the constant current value must be conservatively set at a level to account for the maximum fuze power draw, even though this may only occur over a brief portion of the entire setting operation.

There is a need to improve the efficiency of power delivery to charge storage devices and fuze electronics with power supplies and power needs that vary over time.

BRIEF SUMMARY

Embodiments of the present invention comprise apparatuses and methods to improve the efficiency of power delivery to charge storage devices and fuze electronics with power supplies and power needs that vary over time.

An embodiment of the invention comprises a fuze power conversion circuit for a projectile. A voltage monitor is operably coupled to a power source signal and is configured to generate a source voltage indicator. A current monitor is operably coupled to the power source signal and is configured to generate a source current indicator. A combiner is operably coupled to the source voltage indicator and the source current indicator and is configured to generate a current adjustment signal in response to at least one of the source voltage indicator and the source current indicator. A DC-DC converter is configured to convert the power source signal to a power output signal and to adjust a current level of the power output signal responsive to the current adjustment signal.

Another embodiment of the invention comprises a fuze for a projectile, which includes a rectifier configured for converting an AC input from a setter signal to a DC input signal. Fuze electronics are configured for controlling detonation of the projectile and receiving power from the DC input signal. A fuze power conversion circuit includes a power input determiner and a power converter. The power input determiner is configured for generating a current adjustment signal in response to determining a power amount on the DC input signal from sensing a current and a voltage on the DC input signal. The power converter is configured for converting the DC input signal to a DC output signal wherein the current adjustment signal modifies a current output on the DC output signal to maintain a power level of the DC input signal substantially near a predefined level.

Another embodiment of the invention comprises a method for converting power for a fuze in a projectile. The method includes converting a DC source signal to a DC output signal responsive to at least one PWM signal. A charge storage device is charged with at least some power from the DC output signal. A voltage and a current of the DC source signal are sensed and a power input on the DC source signal is determined responsive to a combination of the sensed voltage and current of the DC source signal. The at least one PWM signal is generated in response to the determined power input to maintain the power input substantially near a predefined level.

DETAILED DESCRIPTION

Figure 1:
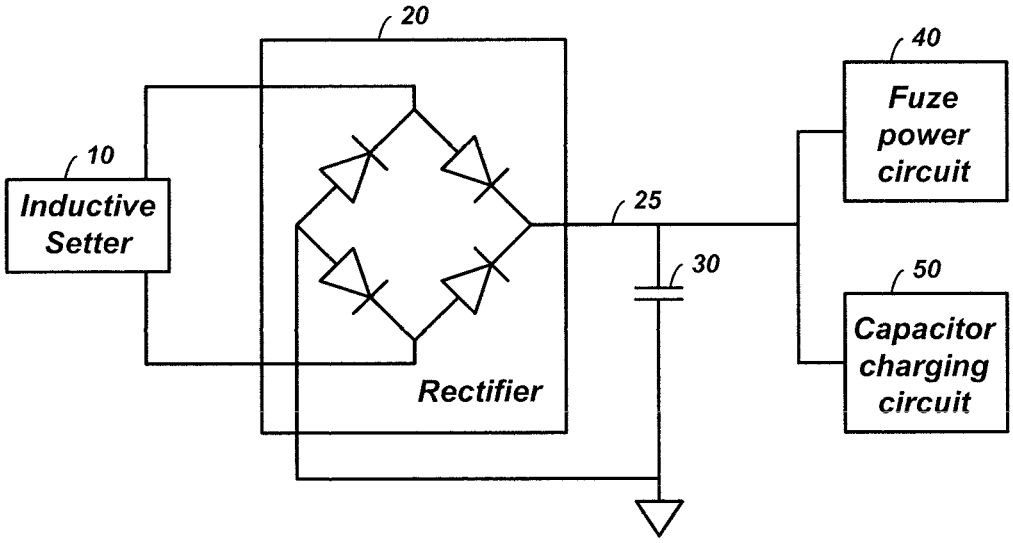
FIG. 1 illustrates a fuze circuitry used to extract power from an inductive setter.

In the following detailed description, reference is made to the accompanying drawings which form a part hereof, and in which is shown by way of illustration specific embodiments in which the invention may be practiced. These embodiments are described in sufficient detail to enable those of ordinary skill in the art to practice the invention. It should be understood, however, that the detailed description and the specific examples, while indicating examples of embodiments of the invention, are given by way of illustration only and not by way of limitation. From this disclosure, various substitutions, modifications, additions rearrangements, or combinations thereof within the scope of the present invention may be made and will become apparent to those skilled in the art.

In accordance with common practice the various features illustrated in the drawings may not be drawn to scale. The illustrations presented herein are not meant to be actual views of any particular method, device, or system, but are merely idealized representations that are employed to describe various embodiments of the present invention. Accordingly, the dimensions of the various features may be arbitrarily expanded or reduced for clarity. In addition, some of the drawings may be simplified for clarity. Thus, the drawings may not depict all of the components of a given apparatus (e.g., device) or method. In addition, like reference numerals may be used to denote like features throughout the specification and figures.

It should be understood that any reference to an element herein using a designation such as "first," "second," and so forth does not limit the quantity or order of those elements, unless such limitation is explicitly stated. Rather, these designations may be used herein as a convenient method of distinguishing between two or more elements or instances of an element. Thus, a reference to first and second elements does not mean that only two elements may be employed there or that the first element must precede the second element in some manner. Also, unless stated otherwise a set of elements may comprise one or more elements.

Embodiments of the present invention comprise apparatuses and methods to improve the efficiency of power delivery to charge storage devices and fuze electronics with power supplies and power needs that vary over time.

Figure 3:
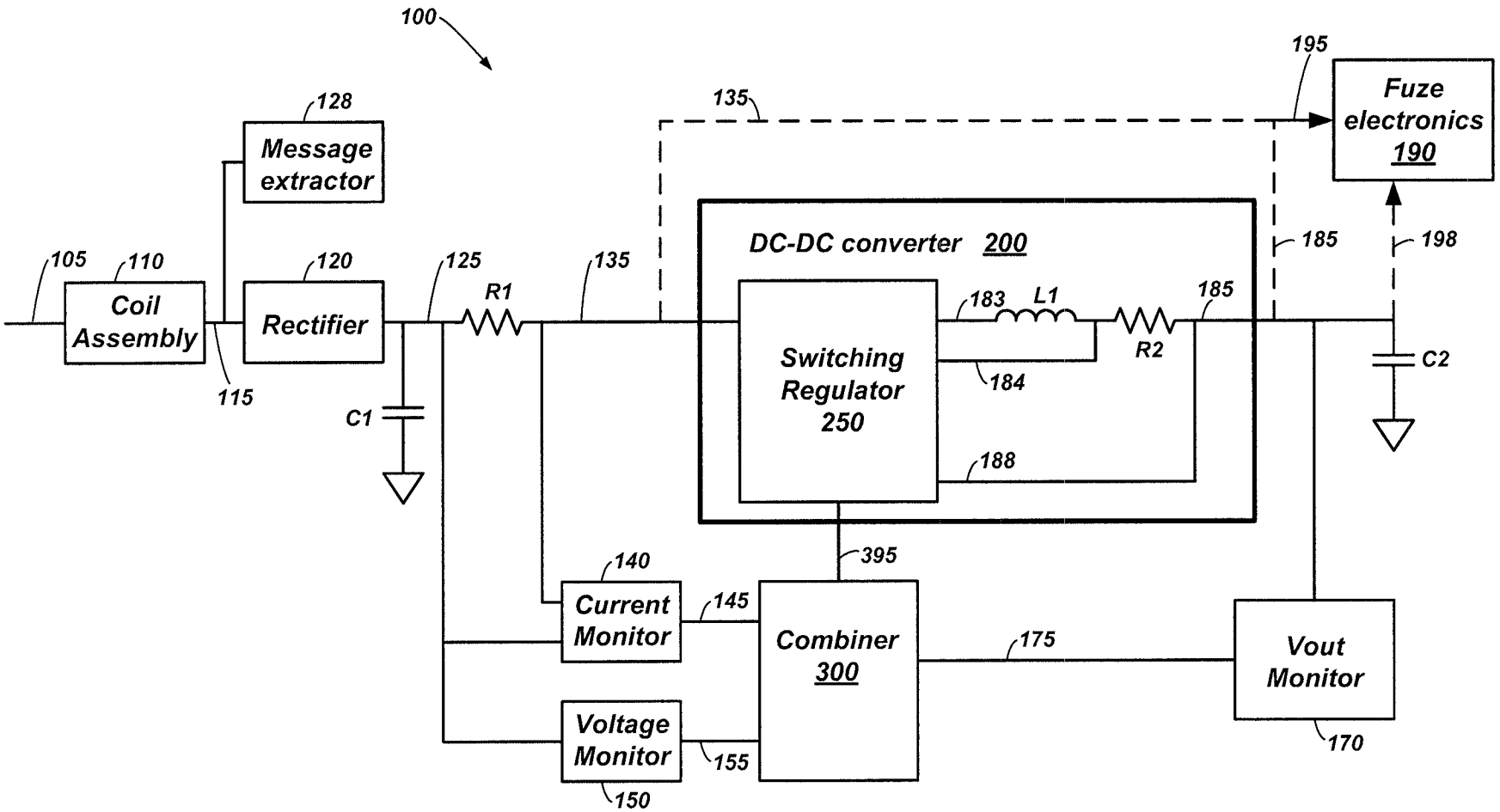
FIG. 3 is a simplified block diagram of a fuze power conversion circuit according to one or more embodiments of the present invention.

FIG. 3 is a simplified block diagram of a fuze power conversion circuit 100 according to one or more embodiments of the present invention. A setter signal 105 from a launch apparatus (not shown) is conveyed by an inductive setter. From the setter signal 105, an AC signal 115 is generated by a coil assembly 110. The AC signal 115 may be used by a message extractor 128 to extract fuze programming and other information from the AC signal 115. For example, the AC signal 115 may include amplitude modulated or frequency modulated signals on the base AC signal 115 as the message.

The AC signal 115 feeds a rectifier 120 (such as, for example, a full-wave diode bridge) to convert the AC signal 115 to a Direct Current (DC) signal 125 (may also be referred to herein as a rectifier output 125). A capacitor C1 may be used to filter the rectified voltage to create a more stable and smooth DC signal 125. A resistor R1 causes a small voltage drop between the DC signal 125 and a power source signal 135 (may also be referred to herein as a DC source signal 135 or a DC input signal 135).

A current monitor 140 coupled to the DC signal 125 and the power source signal 135 may be used to sense the voltage drop across the resistor R1 and thus evaluate a current on the power source signal 135. As a non-limiting example, the current monitor 140 may be an amplifier coupled between the DC signal 125 and the power source signal 135 to generate a source current indicator 145 as a voltage correlated to the current on the power source signal 135, which may be indicated by the voltage drop across the resistor R1. Of course, other current monitors 140 may also be used, such as, for example, a current monitor 140 that can directly sense the current on the power source signal 135 without requiring resistor R1 and the voltage drop therefrom.

A voltage monitor 150 coupled to the DC signal 125 or the power source signal 135 (FIG. 3 illustrates a connection to the DC signal 125) may be used to sense a voltage on the power source signal 135. As a non-limiting example, the voltage monitor 150 may be a simple resistor divider network (not shown) to generate a source voltage indicator 155 as a voltage correlated to the voltage on the power source signal 135. Of course, other voltage monitors 150 may also be used, such as, for example, a buffer or an amplifier coupled to the resistor divider network or to the power source signal 135.

The power source signal 135 feeds a DC-DC converter 200 (may also be referred to herein as a power converter 200) for generating a power output signal 185 (may also be referred to herein as a DC output signal 185). As a non-limiting example, the DC-DC converter 200 may be a buck converter that uses a switching regulator 250 and pulse-width modulation of currents through an inductor L1.

The power output signal 185 may operably couple to a charge storage device C2, such as, for example, a capacitor, a bank of capacitors, a super-capacitor, or a bank of super-capacitors. The charge storage device C2 may be used to store energy produced by the DC-DC converter 200 for later use by the fuze electronics 190 (may also be referred to herein more generically as a load 190). In addition, the charge storage device C2 may assist in filtering the power output signal 185 to produce a smoother and more stable DC output. Of course, while not shown, a person of ordinary skill in the art will recognize that other passive components such as resistors and additional capacitors (not shown) may be used in filtering the power output signal 185.

An output voltage monitor 170 may be included to sense a voltage on the power output signal 185. The output voltage monitor 170 may be embodied as a simple resistor divider network (not shown) to generate an output voltage indicator 175 as a voltage correlated to the voltage on the power output signal 185. Of course, as with the voltage monitor 150, the output voltage monitor 170 may be configured in many different ways. As non-limiting examples, a buffer may be used or an amplifier coupled to a resistor divider network may be used. Moreover, the output voltage indicator 175 may be conditioned with processes, and apparatuses configured to perform the processes, such as filtering or voltage level adjustments up or down to achieve a substantially smooth voltage correlated to the power output signal 185 and at a level for use by a combiner 300.

Figure 4:
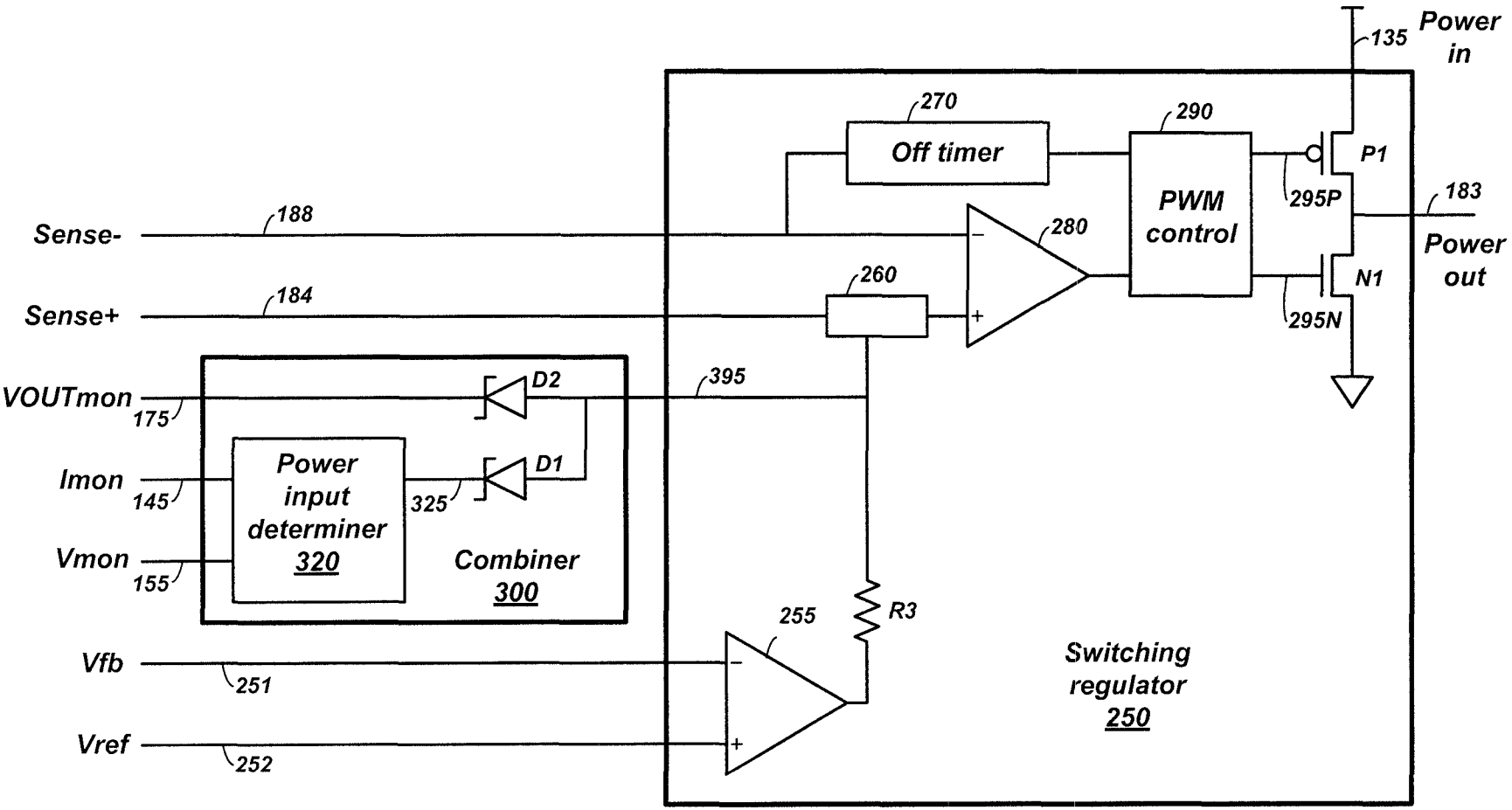
FIG. 4 is a simplified block diagram illustrating additional detail of the switching regulator and combiner of the faze power conversion circuit of FIG. 3.

As will be explained more fully below with reference to FIGS. 4, 5A, and 5B, the combiner 300 may combine one or more of the source current indicator 145, the source voltage indicator 155, and the output voltage indicator 175, to generate a current adjustment signal 395 to the switching regulator 250.

In the buck converter embodiment illustrated in FIG. 3, a switched power output 183 drives the inductor L1 and the charge storage device C2 to create the power output signal 185. A high sense signal 184 coupled to the inductor L1 may feed back to the switching regulator 250 as an indication of the voltage produced by the DC-DC converter 200. In addition, a feedback resistor R2 may be coupled between the high sense signal 184 and the power output signal 185 to create a small voltage drop between the high sense signal 184 and the power output signal 185. The power output signal 185 may be coupled to the switching regulator 250 as a low sense signal 188 such that the voltage drop across feedback resistor R2 indicates an amount of current being supplied by the power output signal 185.

In some embodiments, the power output signal 185 may be coupled to the charge storage device C2 and the fuze electronics 190 to share the current produced by the DC-DC converter 200. In such a configuration, power not used by the fuze electronics 190 as a fuze power input 195 will charge the charge storage device C2. Thus, when power is no longer being supplied by the setter signal 105, and as a result, the DC-DC converter 200, the fuze electronics 190 may draw from the charge storage device C2 to provide additional power.

In other embodiments, the power source signal 135 may be used as the fuze power input 195. In such a configuration, the amount of power available to the DC-DC converter 200 may be reduced by the amount of power used by the fuze power input 195. The power output signal 185 will charge the charge storage device C2. In such a configuration, when power is no longer being supplied by the setter signal 105, the fuze electronics 190 may draw from the charge storage device C2 to provide additional power on an additional fuze power input 198.

As non-limiting examples for one embodiment, the voltage level on the power output signal 185 may be in a range of about 10-25 volts while the voltage level on the power source signal 135 may be in a range of about 28-32 volts.

Conventional DC-DC converters generally track a voltage on the output and feed this voltage back to a pulse-width-modulation control to adjust pulse widths of the current through the inductor L1 to control overall voltage levels on the output. Generally, DC-DC converters don't track input voltages and input currents because those parameters are usually less important, or well known, in the overall system and the important factor for the DC-DC converter is to create a stable output at a specified voltage. However, with fuze electronics 190 powered by inductive setters 105, the amount of power available is very limited. As a result, it is desirable to capture as much of that energy as possible. In addition, the amount of current or power that may be drawn from the inductive setter is required to be maintained at or below a predefined limit. As discussed above, with reference to FIG. 1, for many DC-DC converters with a power limit on the input, the energy capture efficiency may be only 50% for charging a capacitor.

Accordingly, to substantially optimize charging of the charge storage device C2, it may be useful to track the input to the DC-DC converter 200 as a function of voltage, current, or power to better deliver current to the charge storage device C2 for storing energy to be used later by the fuze electronics 190. Embodiments of the present invention provide more efficient energy capture for inductive fuzing applications. The embodiments monitor output power from the inductive setter 105 and draw substantially near the maximum available power until the charge storage device C2 is fully charged. As the fuze electronics 190 power requirements fluctuate (i.e., present a time-varying load), the increased or decreased available energy for the charge storage device C2 is detected and excess energy is re-directed into the charge storage device C2 in response to the detected available energy. In other words, the energy capture process for inductive fuzing applications increases power capture efficiency by dynamically throttling the charging current to the charge storage device C2 based on the amount of available energy from the inductive setter 105.

The switching regulator 250 may be configured to have a current limit (e.g., based on the high sense signal 185 and the low sense signal 188) that is used to limit the cycle by cycle maximum current through the inductor L1 as well as a maximum limit for any component in series with the charging current. This current limit may be set well above the peak storage capacitor charging current such that current is available for both the charge storage device C2 and the fuze electronics 190.

In addition, the charge storage device C2 may have a voltage charging limit at which it is fully charged. Once the charge storage device C2 reaches this predetermined voltage threshold, the combiner 300 may use the output voltage indicator 175 to control the current adjustment signal 395 to substantially reduce the amount of power produced by the DC-DC converter 200. The reduced power from the DC-DC converter 200 is sufficient because only a trickle power is needed to maintain the charge storage device C2 at full charge or the power output need is substantially reduced because there is only a need to supply power to the fuze electronics 190.

The buck converter and the switching regulator 250 described herein use an example of a synchronous buck converter using a forward current switch (i.e., P1) and a reverse current switch (i.e., N1). However, other embodiments, such as a basic buck converter (which uses a reverse bias diode in place of the reverse current switch) or a boost converter may also be used in embodiments of the present invention. In addition, the switching regulator 250 described herein uses a constant off-time type control for the pulse-width modulation. Other pulse-width modulation may be used with embodiments of the present invention, such as, for example, a constant period type control. FIG. 4 is a simplified block diagram illustrating additional detail of the switching regulator 250 and the combiner 300 of the fuze power conversion circuit 100 of FIG. 3. Both FIGS. 3 and 4 are used in much of the description of operation of the switching regulator 250 and the combiner 300. A comparator 280 compares the difference in voltages on the low sense signal 188 and the high sense signal 184, which are connected across the feedback resistor R2. A p-channel transistor P1 is coupled between the power source signal 135 and the switched power output 183. An n-channel transistor N1 is coupled in series between the p-channel transistor P1 and ground. When the voltage drop across the feedback resistor R2 reaches a high threshold value, a pulse-width-modulation (PWM) control circuit 290 negates PWM signal 295P to turn off the p-channel transistor P1 and asserts the PWM signal 295N to turn on the n-channel transistor N1. In other words, the current on the power output signal 185 has reached a high enough level that the increasing current storing energy in the inductor L1 should be reversed through the n-channel transistor N1 to extract the stored energy in the inductor L1.

An off timer 270 tracks the voltage on the low sense signal 188 to estimate when a voltage level on the power output signal 185 has fallen below a low threshold value. At that time, the PWM control circuit 290 asserts the PWM signal 295P to turn on the p-channel transistor P1 and negates the PWM signal 295N to turn off the n-channel transistor N1. In other words, the current on the power output signal 185 has reached a low enough level that sufficient energy stored in the inductor L1 has been extracted and current should be supplied to the inductor L1 to begin storing energy in the inductor L1. This process of reversing current through the inductor L1 is repeated such that the voltage drop across the feedback resistor R2 oscillates between the high threshold and the low threshold.

A voltage level adjuster 260 coupled between the comparator 280 and the high sense signal 184 may be used to adjust the high threshold value at which the PWM control circuit 290 shuts off the p-channel transistor P1. In a baseline configuration, a gain stage 255 drives resistor R3 to create a baseline voltage for the voltage level adjuster 260. A feedback voltage 251 may be compared to a reference voltage 252 by the gain stage 255 to create the baseline voltage. As a non-limiting example, the reference voltage 252 may be set to about 1.25 volts and the feedback voltage 251 may be coupled to a voltage divider coupled to the low sense signal 188, such that at a steady state condition on the feedback voltage 251 is substantially near the reference voltage 252. In this configuration, as the current on the power output signal 185 increases, the voltage on the power output signal 185 will decrease slightly, which will cause the gain stage 255 to slightly increase the comparator threshold at the comparator 280.

The combiner 300 may further modify the comparator threshold through the current adjustment signal 395. Reverse bias Zener diodes D1 and D2 may be configured with a reverse breakdown voltage near or above the baseline voltage produced by the gain stage 255 and resistor R3.

As stated earlier, the output voltage indicator 175 may be configured to produce a voltage correlated to the predetermined voltage threshold at which the charge storage device C2 is fully charged. At that point, the output voltage monitor 170 may be configured to place a low enough voltage on the output voltage indicator 175 to drive the current adjustment signal 395 lower. The lower current adjustment signal 395 will change the comparator threshold at the comparator 280 via the voltage level adjuster 260, such that the current output on the power output signal 185 is throttled back to a much lower level.

As another control path, a power input determiner 320 may generate a current level adjustment signal 325 to lower the compartor threshold at the comparator 280 via the voltage level adjuster 260. The power input determiner 320 uses the source current indicator 145 and the source voltage indicator 155 to generate the current level adjustment signal 325. Thus, the power input determiner 320 can make adjustments to the amount of current produced on the power output signal 185, via the current level adjustment signal 325, in response to the amount of power being delivered on the power source signal 135.

Figure 5A:
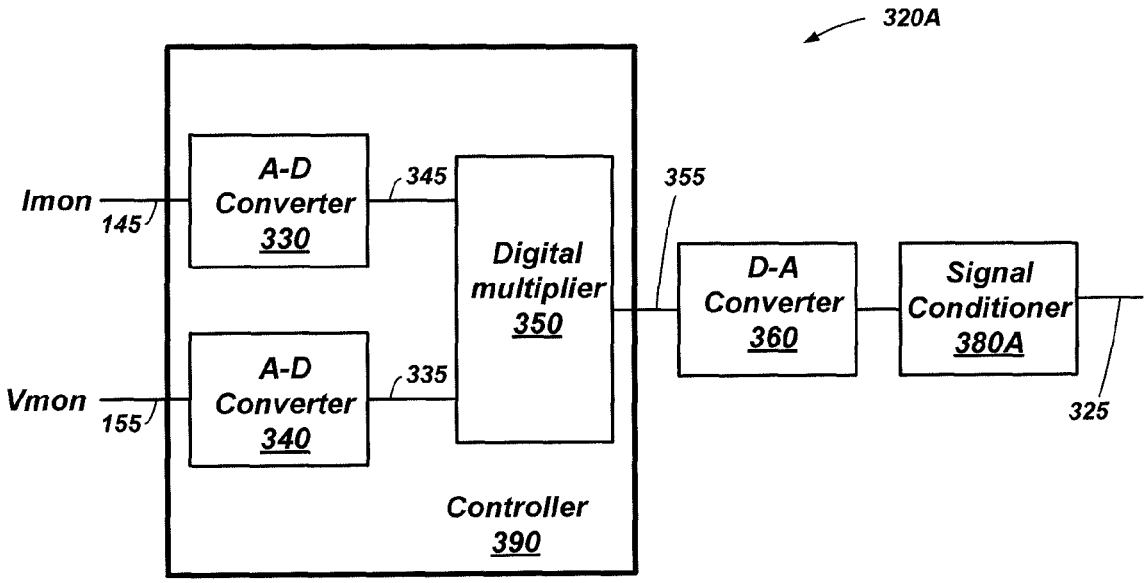
FIGS. 5A and 5B are simplified block diagrams illustrating possible embodiments of a power input determiner.
Figure 5B:
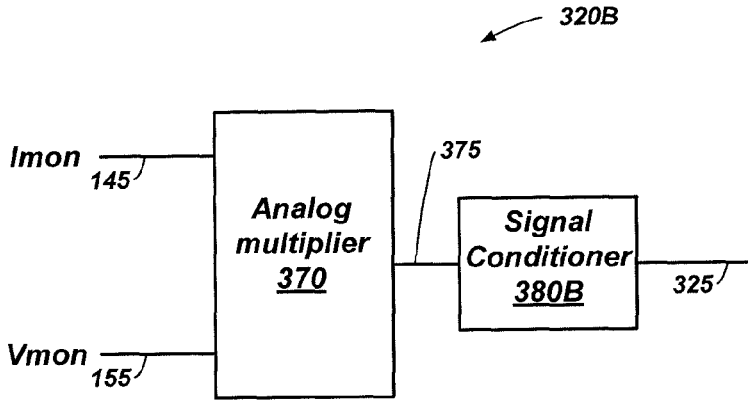

FIGS. 5A and 5B are simplified block diagrams illustrating two example embodiments for the power input determiner 320. In FIG. 5A, a digital embodiment of the power input determiner 320A includes an analog-to-digital converter 330 to convert the source current indicator 145 to a digital current value 345. Another analog-to-digital converter 340 converts the source voltage indicator 155 to a digital voltage value 335. A digital multiplier 350 multiplies together the digital voltage value 335 and the digital current value 345 to arrive at a digital power value 355. A digital-to-analog converter 360 converts the digital power value 355 back to an analog signal as the current level adjustment signal 325. A signal conditioner 380A may be included to adjust the current level adjustment signal 325 to appropriate levels for the voltage level adjuster 260 (FIG. 4) by filtering, adjusting the voltage level, or a combination thereof. The digital multiplier 350 may be included in a controller 390 configured for performing additional functions for the fuze electronics 190 (FIG. 3). In some embodiments, the analog-to-digital converters 330 and 340 may be included in the controller 390 (FIG. 3). In other embodiments, the analog-to-digital converters 330 and 340 may be discrete parts. Moreover, a single analog-to-digital converter (330 or 340) may be time multiplexed to provide the digital voltage value 335 from the source voltage indicator 155 and provide the digital current value 345 from the source current indicator 145. In addition, the digital-to-analog converter 360 may be a discrete part or included in the controller 390. When included in the controller 390, the signal conditioner 380A may perform its functions digitally before or after the digital-to-analog conversion.

In FIG. 5B, an analog embodiment of the power input determiner 320B is illustrated. An analog multiplier 370 may be configured to perform a multiplication of the source current indicator 145 and the source voltage indicator 155 to generate an analog power output 375. A signal conditioner 380B may be included to adjust the current level adjustment signal 325 to appropriate levels for the voltage level adjuster 260 by filtering, adjusting the voltage level, or a combination thereof.

To mitigate the impact of short term transient behavior, both the source current indicator 145 and the source voltage indicator 155 may be averaged over a sliding time window to determine an average value for the appropriate indicator over the time window. The averaging may be performed in the analog domain, such as, for example, by appropriate low-pass filtering circuitry The averaging may also be performed in the digital domain by averaging multiple samples of the digital current value 345 and the digital voltage value 355 (FIG. 5A) over the sliding time window. Providing average values may assist in generating a more stable power output by removing noise or other undesired transients from the raw signals. Of course, the length of the sliding time window may be adjusted depending on the application, the expected variations in signals, and the response time of the feedback loops in the DC-DC converter 200 (FIG. 3).

In some embodiments, the rectifier output (125 in FIG. 3) may vary over a wide voltage range. In such embodiments, it may be best to use a current control system that is responsive to the overall input power as a product of the source voltage indicator 155 and the source current indicator 145, as described above. These embodiments may be referred to herein as input-power responsive systems.

In other embodiments, it may be appropriate to control the current on the power output signal 185 in response to only the source voltage indicator 155 or only the source current indicator 145. In such embodiments, the multiplier may be configured to multiply the appropriate indicator (voltage 155 or current 145) by a constant or unity.

In an input-voltage responsive system, the power input determiner 320 would generate a voltage indication. Thus, the DC-DC converter 200 can throttle current to the charge storage device C2 by pulling the rectified voltage down to a minimum level. In other words, a voltage level on the power source signal 135 can be monitored. As more power is drawn from the inductive setter 105, the voltage level on the power source signal 135 will decrease. The DC-DC converter 200 will pull as much power as possible from the inductive setter 105 until the voltage level on the power source signal 135 is pulled down to a preset level and then throttle the current on the power output signal 185, via the current level adjustment signal 325, to maintain the voltage level on the power source signal 135 at or near the preset level.

In an input-current responsive system, the power input determiner 320 would generate a current indication to throttle the DC-DC converter 200. In other words, The DC-DC converter 200 will increase the current on the power output signal 185 until the average current on the power source signal 135 reaches a preset maximum level. Then, the DC-DC converter 200 can throttle the current on the power output signal 185, via the current level adjustment signal 325, to draw at or near the maximum specified current for the power source signal 135.

Figure 6A:
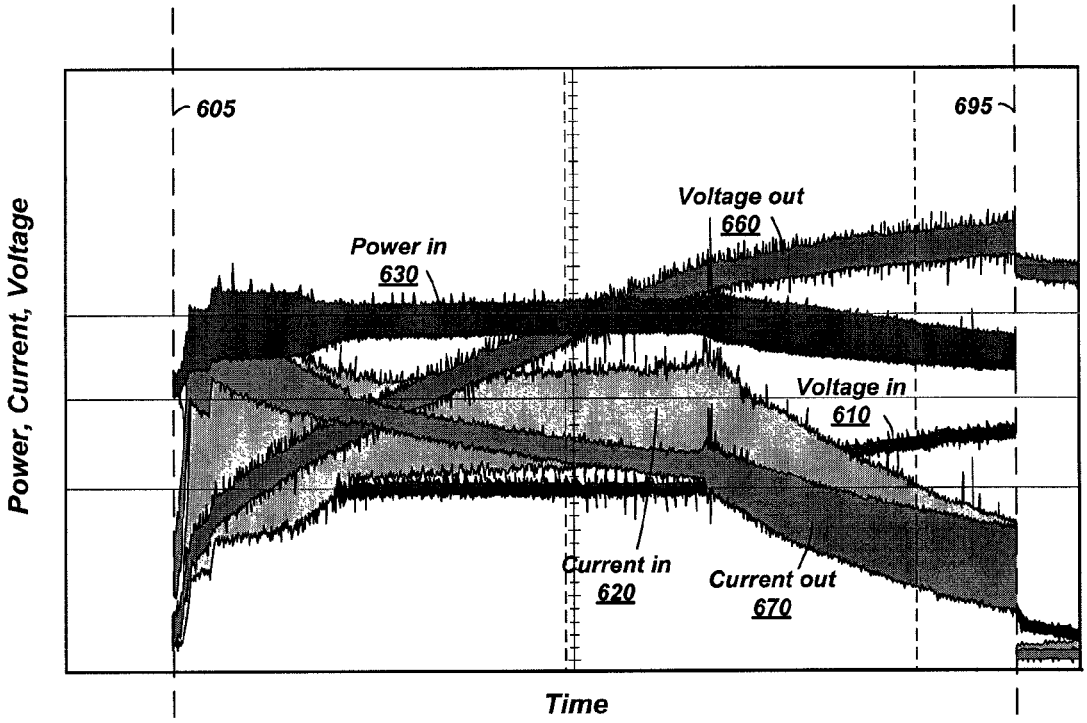
FIG. 6A illustrates plots of various signals for the fuze power conversion circuit of FIG. 3.
Figure 6B:
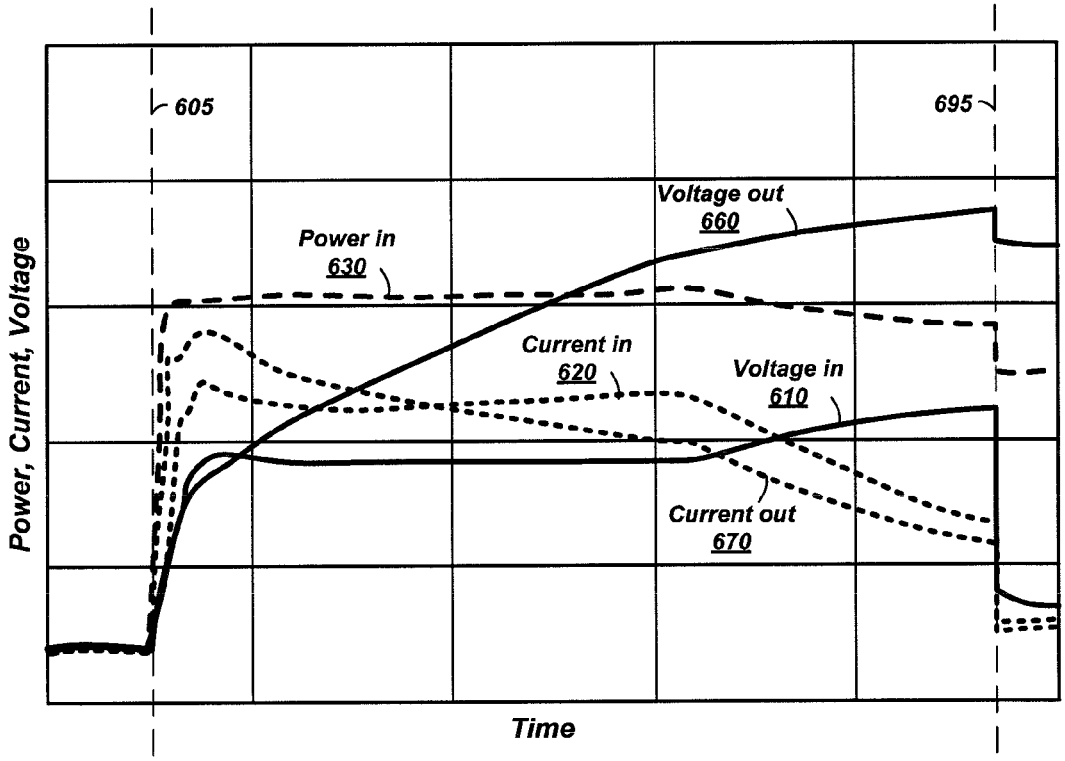
FIG. 6B illustrates the plots of FIG. 6A with noise and oscillations removed to better see the average DC signals for the fuze power conversion circuit of FIG. 3.

FIG. 6A illustrates plots of various signals for the fuze power conversion circuit of FIG. 3 when configured in an input-power responsive system. FIG. 6B illustrates the plots of FIG. 6A with noise and oscillations removed to better see the average DC signals for the fuze power conversion circuit of FIG. 3. FIG. 3 will also be referred to in discussing FIGS. 6A and 6B. Line 610 illustrates "voltage in" on the power source signal 135. Line 620 illustrates "current in" on the power source signal 135. Line 660 illustrates "voltage out" on the power output signal 185 and line 670 illustrates "current out" on the power source signal 135. Line 630 illustrates "power in" on the power source signal 135 as a product of the voltage in 610 and the current in 620.

The voltage in 610 is shown in ×10 volts and the voltage out 660 is shown in volts. The current in 620 and the current out 670 are shown in amps. The power in 630 is shown in watts.

Figure 2:
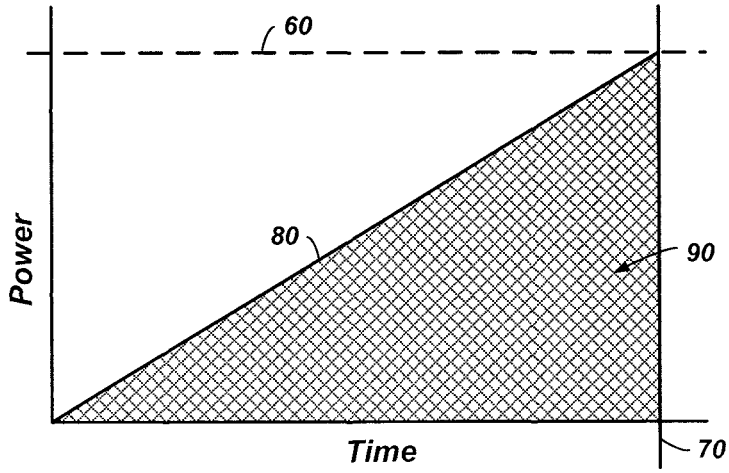
FIG. 2 illustrates a constant current power ramp to a storage capacitor.

At time 605, power is applied at the inductive setter 105 and the power in line 630 rises rapidly. This rapid rise is opposed to a conventional system as illustrated in FIGS. 1 and 2 wherein the power rises slowly. Once the power in line 630 reaches a specified power level, the DC-DC converter 200 begins to throttle the current on the power output signal 185 to maintain the power in line 630 at or near the specified power level. When the charge storage device C2 reaches a full charge, the voltage out line 660 will go over the predetermined voltage threshold indicating the charge storage device C2 is fully charged. At that point, indicated by time 695, the feedback path with the output voltage monitor 170 will substantially reduce the current output on the power output signal 185, which also causes the voltage in line 610, the current in line 620, and the voltage out line 660 to drop.

Input-current responsive systems would operate similar to the curves shown in FIGS. 6A and 6B except that there would be no need to monitor the power in line 630 and the current in line 620 would be held near the predefined level for input current. Similarly, input-voltage responsive systems would operate similar to the curves shown in FIGS. 6A and 6B except that there would be no need to monitor the power in line 630 and the voltage in line 610 would be held near the predefined level for input voltage.

Although the present invention has been described with reference to particular embodiments, the present invention is not limited to these described embodiments. Rather, the present invention is limited only by the appended claims and their legal equivalents.

What is claimed is:

1. A fuze power conversion circuit for a projectile, comprising:

a voltage monitor operably coupled to a power source signal and configured for generating a source voltage indicator;

a current monitor operably coupled to the power source signal and configured for generating a source current indicator;

a combiner operably coupled to the source voltage indicator and the source current indicator and comprising a power input determiner configured for:

multiplying the source voltage indicator and the source current indicator to generate a source power indicator; and generating a current adjustment signal responsive to the source power indicator; and a DC-DC converter configured for converting the power source signal to a power output signal and for maintaining a power level drawn from the power source signal within a predefined range responsive to the current adjustment signal.

2. The fuze power conversion circuit of claim 1, further comprising a charge storage device operably coupled to the power output signal.

3. The fuze power conversion circuit of claim 1, further comprising:

a charge storage device operably coupled to the power output signal; and an output voltage monitor operably coupled to the power output signal and configured for:

generating an output voltage indicator responsive to a voltage on the power output signal; and reducing a power on the power output signal when the charge storage device is charged to a predetermined voltage threshold responsive to the output voltage indicator.

4. The fuze power conversion circuit of claim 1, wherein the combiner is configured for generating the current adjustment signal responsive to only the source current indicator.

5. The fuze power conversion circuit of claim 1, wherein the combiner is configured for generating the current adjustment signal responsive to only the source voltage indicator.

6. The fuze power conversion circuit of claim 1, further comprising:

a load operably coupled to the power output signal; and a charge storage device operably coupled to the power output signal;

wherein the power output signal is configured to concurrently supply power to the load and the charge storage device and the fuze power conversion circuit is further configured to maintain the power level drawn from the power source signal within the predefined range during the supply of power to the load and the charge storage device.

7. The fuze power conversion circuit of claim 6, wherein the load is configured to draw a time-varying load from the power output signal.

8. The fuze power conversion circuit of claim 1, further comprising a rectifier configured to generate the power source signal from a setter signal comprising a pulsed signal including information for a message extractor operably coupled to the setter signal.

9. The fuze power conversion circuit of claim 1, wherein the combiner comprises:

at least one analog-to-digital converter for converting the source voltage indicator to a digital voltage value and converting the source current indicator to a digital current value;

a digital multiplier for multiplying the digital voltage value and the digital current value to generate a digital power value; and a digital-to-analog converter for converting the digital power value to generate the current adjustment signal.

10. The fuze power conversion circuit of claim 9, wherein a controller includes the digital multiplier and is configured to generate the digital power value.

11. The fuze power conversion circuit of claim 10, wherein the controller is further configured for averaging samples of the source voltage indicator over a sliding time window for use as the digital voltage value.

12. The fuze power conversion circuit of claim 10, wherein the controller is further configured for averaging samples of the source current indicator over a sliding time window for use as the digital current value.

13. The fuze power conversion circuit of claim 1, wherein the combiner comprises an analog multiplier for generating the current adjustment signal as a product of the source voltage indicator and the source current indicator.

14. A fuze for a projectile, comprising:

a rectifier configured for converting an AC input from a setter signal to a DC input signal;

fuze electronics configured for controlling detonation of the projectile and receiving power from the DC input signal; and a fuze power conversion circuit comprising:

a power input determiner configured for generating a current adjustment signal responsive to determining a power amount on the DC input signal from sensing a current on the DC input signal and a voltage on the DC input signal and multiplying a value for the sensed current by a value for the sensed voltage to arrive at the power amount for the generating the current adjustment signal; and a power converter configured for converting the DC input signal to a DC output signal wherein the current adjustment signal modifies a current output on the DC output signal to maintain a power level of the DC input signal within a predefined range.

15. The fuze of claim 14, further comprising a charge storage device operably coupled to the DC output signal.

16. The fuze of claim 14, further comprising:

a charge storage device operably coupled to the DC output signal; and an output voltage monitor configured for generating an output voltage indicator responsive to a voltage on the DC output signal;

wherein the power converter is further configured for reducing a power on the DC output signal responsive to the output voltage indicator reaching a predetermined voltage threshold.

17. The fuze of claim 14, further comprising a charge storage device operably coupled to the DC output signal and wherein the fuze power conversion circuit is further configured to maintain the power level drawn from the DC input signal within the predefined range during supply of power to the fuze electronics and the charge storage device.

18. The fuze of claim 17, wherein the fuze electronics are configured to draw a time-varying load from the DC input signal.

19. The fuze of claim 14, wherein the power input determiner comprises:

at least one analog-to-digital converter for converting the sensed voltage on the DC input signal to a digital voltage value and converting the sensed current on the DC input signal to a digital current value;

a digital multiplier for multiplying the digital voltage value and the digital current value to generate a digital power value; and a digital-to-analog converter for converting the digital power value to generate the current adjustment signal.

20. The fuze of claim 19, wherein a controller includes the at least one analog-to-digital converter and the digital multiplier.

21. The fuze of claim 14, wherein the power input determiner comprises an analog multiplier for generating the current adjustment signal as a product of the sensed voltage on the DC input signal and the sensed current on the DC input signal.

22. A method for converting power for a fuze in a projectile, comprising:

converting a DC source signal to a DC output signal responsive to at least one PWM signal;

charging a charge storage device with at least some power from the DC output signal;

sensing a voltage of the DC source signal;

sensing a current of the DC source signal;

determining a power input on the DC source signal responsive to a multiplication of the sensed voltage of the DC source signal and the sensed current of the DC source signal; and generating the at least one PWM signal responsive to the determined power input to maintain a power amount of the power input within a predefined range.

23. The method of claim 22, further comprising:

sensing a voltage of the DC output signal; and reducing a power on the DC output signal when the charge storage device is charged to a predetermined voltage threshold responsive to the sensed voltage of the DC output signal.

24. The method of claim 23, wherein the current of the DC source signal is maintained at a fixed value.

25. The method of claim 23, wherein the voltage of the DC source signal is maintained at a fixed value.

26. The method of claim 22, further comprising, concurrent with charging the charge storage device, supplying power to a load from at least one of the DC source signal and the DC output signal while maintaining the power amount of the power input within the predefined range.

27. The method of claim 26, wherein the load is configured to draw a time-varying amount of power.

28. The method of claim 22, wherein the determining the power input on the DC source signal further comprises:

converting the sensed voltage on the DC source signal to a digital voltage value;

converting the sensed current on the DC source signal to a digital current value;

multiplying the digital voltage value and the digital current value to generate a digital power value; and converting the digital power value to generate an analog signal as the determined power input.

29. The method of claim 22, wherein the determining the power input on the DC source signal further comprises multiplying an analog signal of the sensed voltage on the DC source signal with an analog signal of the sensed current on the DC source signal to generate an analog signal as the determined power input.

* * * * *

UNITED STATES PATENT AND TRADEMARK OFFICE

CERTIFICATE OF CORRECTION

PATENT NO. : 8,723,493 B2
APPLICATION NO. : 12/899326
DATED : May 13, 2014
INVENTOR(S) : James A. Ring It is certified that error appears in the above-identified patent and that said Letters Patent is hereby corrected as shown below:

In the specification:

| | | |
|---|---|---|
| COLUMN 3, | LINE 5, | change "of the faze" to --of the fuze-- |
| COLUMN 8, | LINE 12, | change "controller **390** (FIG. 3)." to --controller **390**.-- |

Signed and Sealed this
Tenth Day of May, 2016

Michelle K. Lee

Michelle K. Lee
*Director of the United States Patent and Trademark Office*